US007496303B2

(12) United States Patent
Kamoda

(10) Patent No.: US 7,496,303 B2
(45) Date of Patent: Feb. 24, 2009

(54) FIXING DEVICE, IMAGE FORMING APPARATUS HAVING THE SAME AND IMAGE FORMING METHOD

(75) Inventor: Yuji Kamoda, Ibaraki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 220 days.

(21) Appl. No.: 11/674,328

(22) Filed: Feb. 13, 2007

(65) Prior Publication Data

US 2007/0201913 A1 Aug. 30, 2007

(30) Foreign Application Priority Data

Feb. 27, 2006 (JP) ..... 2006-050106

(51) Int. Cl.
*G03G 15/00* (2006.01)

(52) U.S. Cl. ..... 399/45; 219/619; 399/67; 399/69; 399/122

(58) Field of Classification Search ..... 399/38, 399/45, 67, 68, 69, 122, 328, 329; 219/619
See application file for complete search history.

(56) References Cited

U.S. PATENT DOCUMENTS

| | | | | |
|---|---|---|---|---|
| 6,246,843 | B1 | 6/2001 | Nanataki et al. | |
| 6,373,036 | B2 * | 4/2002 | Suzuki | 219/619 |
| 7,005,619 | B2 * | 2/2006 | Fujii et al. | 219/619 |

FOREIGN PATENT DOCUMENTS

| | | | |
|---|---|---|---|
| JP | 2001-043965 | A | 2/2001 |
| JP | 2001-60490 | A | 3/2001 |
| JP | 2001-135470 | A | 5/2001 |
| JP | 2003-091185 | | 3/2003 |
| JP | 2003-297542 | | 10/2003 |
| JP | 2005-100699 | | 4/2005 |
| JP | 2005-141952 | | 6/2005 |

OTHER PUBLICATIONS

Office Action issued in corresponding Japanese Patent Application No. 2006-050106, mailed Apr. 15, 2008, and translation thereof.

* cited by examiner

*Primary Examiner*—Hoan H Tran
(74) *Attorney, Agent, or Firm*—Buchanan Ingersoll & Rooney PC

(57) ABSTRACT

A fixing device, an image forming apparatus having the same include a fixing member having an outer peripheral face with which a sheet to be transported is brought into pressure contact, an exciting coil for induction heating of a heat generating layer of the fixing member, and an RF power supply circuit for applying a voltage of a certain drive frequency to the exciting coil. A degaussing coil is placed in small size sheet non-passing regions corresponding to end sections of the outer peripheral face of the fixing member with respect to the width direction of the sheet. A changeover switch opens or closes the degaussing coil in accordance with the size of the sheet to be transported. A control section is provided for changing and setting a drive frequency of the RF power supply circuit along with opening or closing of the degaussing coil.

14 Claims, 11 Drawing Sheets

*Fig.15*

| | DRIVE FREQUENCY SET VALUES [kHz] | |
|---|---|---|
| SET POWER [W] | DEGAUSSING COIL:OPEN | DEGAUSSING COIL:CLOSE |
| ⋮ | ⋮ | ⋮ |
| 300 | 42.9 | 45.6 |
| ⋮ | ⋮ | ⋮ |
| 600 | 41.6 | 44.3 |
| ⋮ | ⋮ | ⋮ |
| 900 | 40.8 | 43.7 |
| ⋮ | ⋮ | ⋮ |
| 1200 | 40.2 | 43.2 |
| ⋮ | ⋮ | ⋮ |

FIXING DEVICE, IMAGE FORMING APPARATUS HAVING THE SAME AND IMAGE FORMING METHOD

This application is based on an application No. 2006-050106 filed in Japan, the contents of which are hereby incorporated by reference.

BACKGROUND OF THE INVENTION

The present invention relates to a fixing device, and more particularly relates to a fixing device of electromagnetic induction heating method.

The present invention also relates to an image forming apparatus having such a fixing device and to an image forming method for forming images by the image forming apparatus. The image forming apparatus includes, for example, electrophotographic copiers, printers, facsimiles and multifunction machines thereof.

As fixing devices of electromagnetic induction heating method, as shown in JP 2001-43965 A, JP 2001-60490 A and JP 2001-135470 A, there has conventionally been known a fixing device having a fixing roller and a pressure roller, which are in pressure contact with each other so as to form a nip section, and having an exciting coil placed along the fixing roller for heating a magnetic material layer (hereinbelow referred to as "heat generating layer") of the fixing roller through electromagnetic induction by the exciting coil, transporting a sheet (recording paper) with a toner image attached thereto through the nip section, and melting and fixing the toner image on the sheet by heat generation in the fixing roller. In those documents, a degaussing coil is provided in regions corresponding to axial end sections of the fixing roller (which are herein referred to as "small size sheet non-passing regions"). When a maximum size sheet passes the regions, the degaussing coil is opened, whereas when a small size sheet passes the regions, the degaussing coil is closed so that changes of a magnetic flux by the exciting coil is cancelled in the regions (small size sheet non-passing regions) where the degaussing coil is placed, by which excessive temperature rise in the axial end sections of the fixing roller is prevented.

SUMMARY OF THE INVENTION

In the conventional example, an inverter circuit for supplying electric power to the exciting coil is provided. The temperature of the fixing roller is controlled by detecting the surface temperature of the fixing roller with a temperature sensor and increasing or decreasing electric power supply to the exciting coil by the inverter circuit so that the surface temperature of the fixing roller becomes a specified target temperature (feedback control).

However, along with opening or closing of the degaussing coil, a load applied onto the exciting coil as viewed from the electric power supply side (inverter circuit), i.e., an inductance and a resistance value of an equivalent circuit, which is composed of the exciting coil, and the degaussing coil and the fixing roller electromagnetically coupled with the exciting coil, change. As a result, immediately after open/close changeover of the degaussing coil, because of the presence of a time lag (a time taken to set a specified electric power value), the feedback control performed based on a temperature detection result causes input of electric power with an electric power value different from a desired electric power value. Consequently, a temperature ripple occurs in the circumferential direction of the fixing roller, and this causes a problem of fixing quality damage such as irregular glossiness. Moreover, when the degaussing coil is changed from open to close, the equivalent circuit is likely driven in a frequency region lower than a resonance frequency of the equivalent circuit in actuality. In such a case, zero electric current switching is not possible, and therefore noise and loss increase. Moreover, since an RF inverter circuit operates out of resonance, the RF inverter circuit can be damaged.

An object of the present invention is to provide a fixing device having a degaussing coil and being capable of preventing excessive temperature rise in a small size sheet non-passing region on a fixing member while being capable of solving problems such as occurrence of temperature ripples in the circumferential direction of the fixing member caused by opening or closing of the degaussing coil.

In order to accomplish the object, a fixing device of the present invention comprises:

a fixing member having an outer peripheral face with which a sheet to be transported is brought into pressure contact;

an exciting coil placed along the outer peripheral face of the fixing member to form an elongated shape with respect to a width direction of the sheet to be transported for induction heating of a heat generating layer of the fixing member;

an RF power supply circuit for applying a voltage of a certain drive frequency to the exciting coil so as to make the heat generating layer of the fixing member generate heat through the exciting coil;

a degaussing coil placed in a small size sheet non-passing region corresponding to a part of the outer peripheral face of the fixing member with respect to the width direction of the sheet along the exciting coil;

a changeover switch for opening or closing the degaussing coil in accordance with a size of the sheet to be transported; and a control section for changing and setting a drive frequency of the RF power supply circuit along with opening or closing of the degaussing coil.

Herein, the term "small size sheet non-passing region" refers to a region through which a maximum size sheet passes but small size sheets smaller than the maximum size sheet do not pass. This region corresponds to a part of the outer peripheral face of the fixing member with respect to the width direction of the sheet.

In the fixing device of the present invention, the degaussing coil is opened or closed by the changeover switch in accordance with the size of the sheet to be transported. The control section changes and sets the drive frequency of the RF power supply circuit along with opening or closing of the degaussing coil. The RF power supply circuit applies a voltage of a changed drive frequency to the exciting coil, by which the heat generating layer of the fixing member is made to generate heat through the exciting coil and the toner is fixed onto the sheet.

Thus, in the fixing device, the degaussing coil is opened or closed in accordance with the size of the sheet, and this makes it possible to prevent excessive temperature rise in the small size sheet non-passing region in the fixing member. In addition, since the drive frequency of the RF power supply circuit is changed and set along with opening or closing of the degaussing coil, desired electric power can be inputted into the fixing member even immediately after the open/close changeover of the degaussing coil. Therefore, problems such as occurrence of temperature ripples in the circumferential direction of the fixing member caused by opening or closing of the degaussing coil can be solved.

In the fixing device in one embodiment, the RF power supply circuit includes a capacitor connected in series to the exciting coil to equivalently constitute a series resonant circuit, and when the degaussing coil is changed from close to open, the control section moves the drive frequency to a side higher than a resonance frequency of the series resonant circuit in a state of the degaussing coil being opened, whereas when the degaussing coil is changed from open to close, the control section moves the drive frequency to a side higher than the resonance frequency of the series resonant circuit in a state of the degaussing coil being closed.

In the fixing device in this embodiment, even immediately after the open/close changeover of the degaussing coil, electric power inputted into the fixing member can easily be controlled, and therefore stable electric power into the fixing member can be achieved.

In the fixing device in one embodiment, the RF power supply circuit includes a capacitor connected in series to the exciting coil to equivalently constitute a series resonant circuit, and when the degaussing coil is changed from close to open, the control section moves the drive frequency in accordance with a resonance frequency of the series resonant circuit shifting to a lower side, whereas when the degaussing coil is changed from open to close, the control section moves the drive frequency in accordance with the resonance frequency of the series resonant circuit shifting to a higher side.

In the fixing device in this embodiment, even immediately after the open/close changeover of the degaussing coil, stable electric power input into the fixing member can be achieved.

The fixing device in one embodiment further comprises a drive frequency table containing predetermined values of the drive frequencies which should be set in accordance with set power amounts for making the fixing member generate heat and with opening or closing of the degaussing coil.

In the fixing device in this embodiment, the control section makes reference to the drive frequency table along with opening or closing of the degaussing coil, so that control over drive frequency changeover in the RF power supply circuit can smoothly be performed.

In the fixing device in one embodiment, the control section moves the drive frequency of the RF power supply circuit by a specified amount along with opening or closing of the degaussing coil.

Herein "specified amount" is determined by a ratio of the drive frequency or determined by a difference from the drive frequency.

In the fixing device in this embodiment, control over drive frequency changeover in the RF power supply circuit along with opening or closing of the degaussing coil can simply be performed.

In the fixing device in one embodiment, the amount of the drive frequency of the RF power supply circuit that the control section moves along with opening or closing of the degaussing coil is constant over an entire region of set power amounts for making the fixing member generate heat.

In the fixing device in this embodiment, control over drive frequency changeover in the RF power supply circuit along with opening or closing of the degaussing coil can more simply be performed.

In the fixing device in one embodiment, the amount of the drive frequency of the RF power supply circuit that the control section moves along with opening or closing of the degaussing coil is variably set in accordance with a certain set power amount for making the fixing member generate heat.

In the fixing device in this embodiment, control over drive frequency changeover in the RF power supply circuit along with opening or closing of the degaussing coil is accurately performed in accordance with the set power amount for making the fixing member generate heat.

In the fixing device in one embodiment, the control section controls the RF power supply circuit in such a way that after changing and setting the drive frequency of the RF power supply circuit along with opening or closing of the degaussing coil, an actual amount of electric power for making the fixing member generate heat continues to be a certain set power amount.

In the fixing device in this embodiment, a desired amount of electric power can be inputted into the fixing member not only immediately after open/close changeover of the degaussing coil but also ongoingly thereafter.

In the fixing device in one embodiment, after changing and setting the drive frequency of the RF power supply circuit, the control section maintains the drive frequency of the RF power supply circuit on a side slightly higher than the resonance frequency of the series resonant circuit.

In the fixing device in this embodiment, a desired amount of electric power can be inputted into the fixing member not only immediately after open/close changeover of the degaussing coil but also ongoingly thereafter.

In the fixing device in one embodiment, the fixing member is a cylindrical roller.

In the fixing device in one embodiment, the fixing member is an endless belt.

In the fixing device in one embodiment, the small size sheet non-passing region corresponds to end sections on both sides of the outer peripheral face of the fixing member with respect to the width direction of the sheet.

An image forming apparatus of the present invention includes an image forming section for attaching toner onto a sheet and the fixing device of the present invention.

An image forming method of the present invention with use of an image forming section for attaching toner onto a sheet and the fixing device of the present invention, includes the steps of:

attaching toner onto a sheet and feeding the sheet to the fixing device by the image forming section;

opening or closing the degaussing coil in accordance with a size of the sheet, and changing and setting a drive frequency of the RF power supply circuit along with opening or closing of the degaussing coil by the control section; and fixing the toner on the sheet by applying a voltage of the changed drive frequency to the exciting coil by the RF power supply circuit so as to make the heat generating layer of the fixing member generate heat through the exciting coil.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 15 is a view showing a part excerpted from a drive frequency table for the fixing device.

DETAILED DESCRIPTION OF THE INVENTION

Hereinbelow, the present invention will be described in detail in conjunction with the embodiments with reference to the accompanying drawings.

Figure 1:
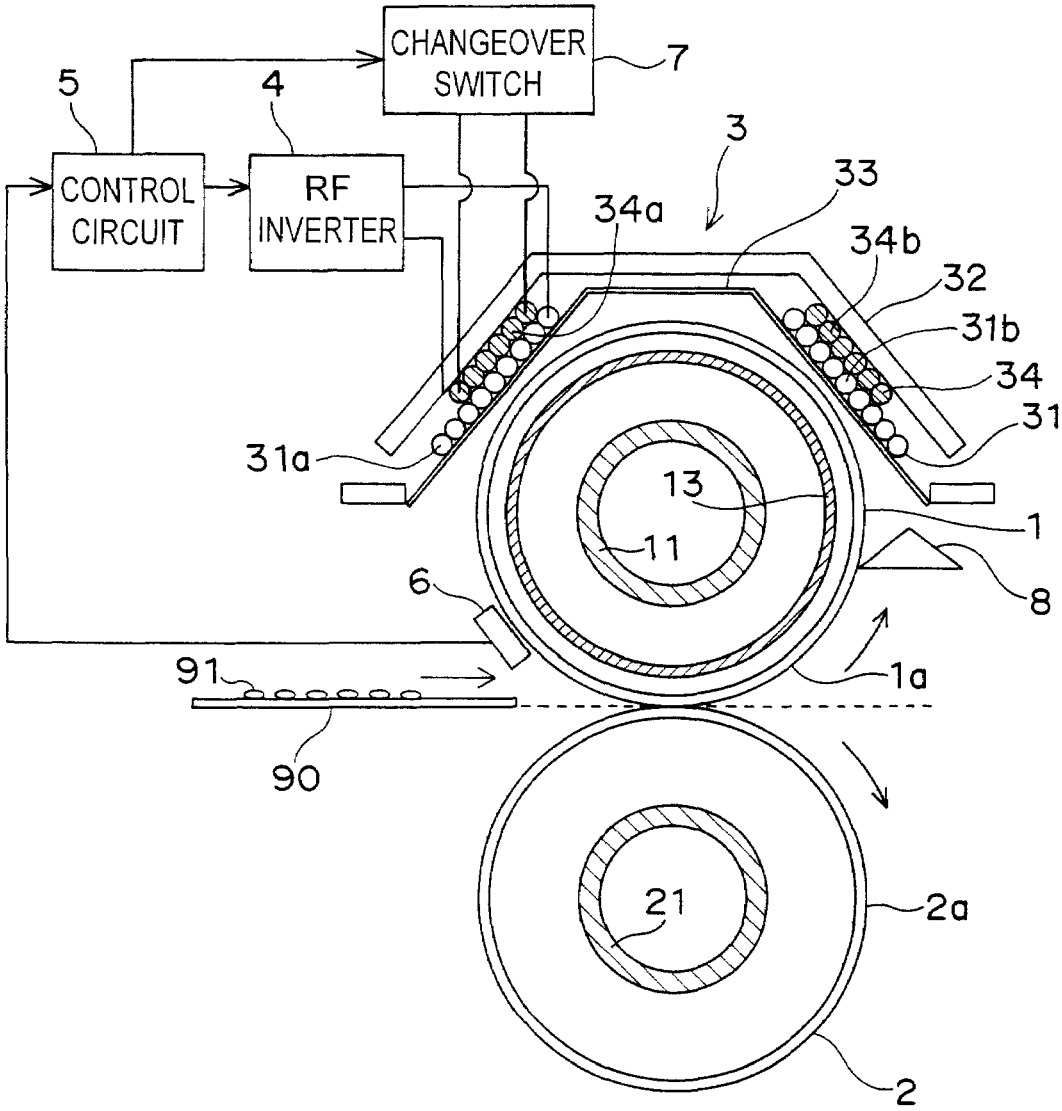
FIG. 1 is a view showing an outlined structure of a fixing device in one embodiment of the present invention.

FIG. 1 shows the cross sectional structure of a fixing device in one embodiment for color laser printers.

The fixing device is mainly composed of a fixing roller 1, a pressure roller 2, a magnetic flux generating section 3, an RF inverter 4 serving as an RF power supply circuit, a control circuit 5 serving as a control section and a changeover switch 7. There are also shown a temperature sensor 6, a separation claw 8 and a paper sheet 90 as a sheet.

The fixing roller 1 and the pressure roller 2, which are cylindrical members extending vertically with respect to the page of FIG. 1, are disposed parallel to each other in the vertical direction in FIG. 1 and both ends of each roller are rotatably supported by an unshown bearing member. The pressure roller 2 is biased toward the fixing roller 1 by an unshown pressing mechanism with use of a spring and the like. Consequently, the lower portion of the fixing roller 1 and the upper portion of the pressure roller 2 are brought into pressure contact with a specified pressing force (described later) so as to form a nip section. The pressure roller 2 is rotationally driven clockwise as shown by an arrow in the drawing at a specified peripheral velocity by an unshown drive mechanism. The fixing roller 1 is rotated following after the pressure roller 2 by frictional force attained by friction with the pressure roller 2 in the nip section. It is to be noted that the fixing roller 1 may be rotationally driven and the pressure roller 2 may be rotated following after the fixing roller 1. That is, the relationship between driving and following may be reversed.

Figure 2:
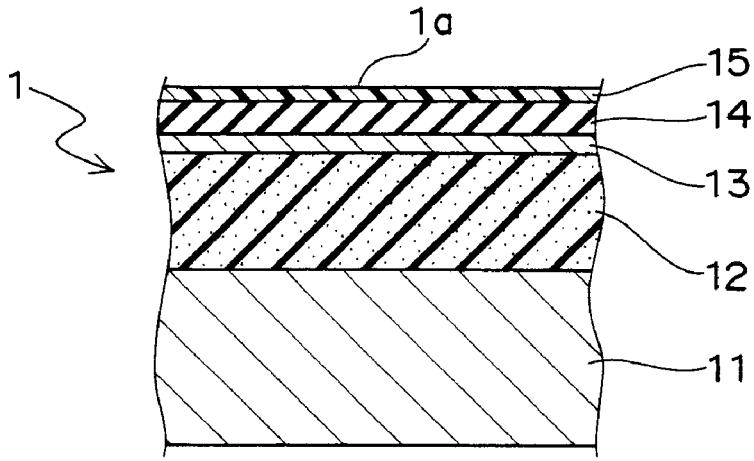
FIG. 2 is a view showing a cross sectional structure of a fixing roller in the fixing device.

As shown in FIG. 2, the fixing roller 1 has a five-layer structure composed of a mandrel 11 serving as a support layer, a heat insulating layer 12, a heat generating layer 13, an elastic layer 14 and a release layer 15 placed in the order from the central side toward an outer peripheral face 1*a*. The hardness of the fixing roller 1 is, for example, 30 to 90 degrees in Asker-C hardness scale.

The mandrel 11 as a support layer in this example is made of aluminum having an outer diameter of 26 mm and a thickness of 4 mm. The material of the mandrel 11 may be a heat-resistant molded pipe made of, for example, iron or PPS (polyphenylene sulfide) as long as the strength can be ensured. However, in order to prevent the mandrel 11 from generating heat, nonmagnetic materials which are less affected by electromagnetic induction heating should preferably be used.

The heat insulating layer 12 is provided mainly for putting the generating layer 13 in a heat insulating state. As the material of the heat insulating layer 12, sponges (heat insulating structures) made from rubber materials and resin materials having heat resistance and elasticity are used. Accordingly, the heat insulating layer 12 plays not only a heat insulating role, but also a role to increase a nip width by allowing deflection of the heat generating layer 13 and to enhance sheet discharge performance and sheet separating performance by decreasing the hardness of the fixing roller 1. In the case where the heat insulating layer 12 is made of a silicon sponge material for example, its thickness is set at 2 mm to 10 mm, preferably 3 mm to 7 mm and its hardness is set at 20 to 60 degrees, preferably 30 to 50 degrees according to an Asker rubber hardness meter. It is to be noted that the heat insulating layer 12 may have a two-layer structure composed of a rubber material and a sponge.

The heat generating layer 13 is provided to generate heat through electromagnetic induction by a magnetic flux from the magnetic flux generating section 3. In this example, the heat generating layer 13 is constituted of an endless electroformed nickel belt layer with a thickness of 40 μm. The thickness of the heat generating layer 13 should preferably be 10 μm to 100 μm and more preferably be 20 μm to 50 μm. The reason why the thickness of the heat generating layer 13 should preferably be 100 μm or less and more preferably be 50 μm or less is to decrease the thermal capacity of the heat generating layer 13 to increase its temperature rise rate. As the material of the heat generating layer 13, those having a relatively high magnetic permeability μ and an appropriate resistivity ρ such as magnetic materials (magnetic metals) including magnetic stainless steels may be used. Even nonmagnetic materials, if having conductivity, such as metals, may be used as the material of the heat generating layer 13 by forming them into thin films. It is to be noted that the heat generating layer 13 may be structured such that particles which generate heat by electromagnetic induction are dispersed over resin. This structure makes it possible to enhance the separating performance.

The elastic layer 14 is provided to promote adhesion (which is important to support color images) between a paper sheet and the surface of the fixing roller by elasticity in the thickness direction. In this example, the elastic layer 14 is made of a rubber material or a resin material having heat resistance and elasticity, and more specifically, made of a heat-resistant elastomer such as silicon rubber and fluorocarbon rubber which can withstand use at fixing temperatures. It is possible to mix various fillers into the elastic layer 14 for the purpose of enhancing thermal conductivity, reinforcement or the like. While examples of thermally conductive particles used as fillers include diamond, silver, copper, aluminum, marble and glass, practical examples thereof include silica, alumina, magnesium oxide, boron nitride and beryllium oxide.

The thickness of the elastic layer 14 should preferably be, for example, 10 μm to 800 μm and more preferably be 100 μm to 300 μm. If the thickness of the elastic layer 14 is less than 10 μm, it is difficult to attain targeted elasticity in the thickness direction. If the thickness exceeds 800 μm, heat generated in the heat generating layer cannot easily reach the outer peripheral face of a fixing film, which causes a tendency for the thermal efficiency to deteriorate.

In the case where the elastic layer 14 is made of silicon rubber, the hardness should be 1 to 80 degrees and preferably 5 to 30 degrees in JIS hardness scale. In this JIS hardness range, it becomes possible to prevent failure in the fixing property of toner while preventing degradation in the strength of the elastic layer and adhesion failure. Specific examples of the silicon rubber include one-component, two-component or three or more-component silicon rubbers, LTV (Low Temperature Vulcanization)-type, RTV (Room Temperature Vulcanization)-type or HTV (High Temperature Vulcanization)-type silicon rubbers, and condensation-type or addition-type silicon rubbers. In this example, as the material of the elastic layer 14, a silicon rubber with a JIS hardness of 10 degree and a thickness of 200 μm is used.

The outermost release layer 15 is provided to enhance the releasing property of the outer peripheral face 1*a*. The material of the release layer 15, which is required to withstand use at fixing temperatures and to have the releasing property for toner, should preferably be made of silicon rubber, fluorocarbon rubber and fluorocarbon resin such as PFA (Tetrafluoroethylene perfluoroalkyl-vinylether copolymer), PTEE (Polytetra fluoroethylene), FEP (Tetra-fluoroethylene hexa-fluoropropylene copolymer) and PFEP (Perfluoroethylene hexa-fluoro-propylene copolymer). The thickness of the release layer 15 should preferably be 5 μm to 100 μm and more preferably be 10 μm to 50 μm. Moreover, adhesion processing with use of primers and the like may be performed in order to enhance interlayer adhesion force. It is to be noted that according to need, the release layer 15 may contain conductive materials, abrasion-resistant materials and good thermal conductive materials as fillers.

Figure 3:
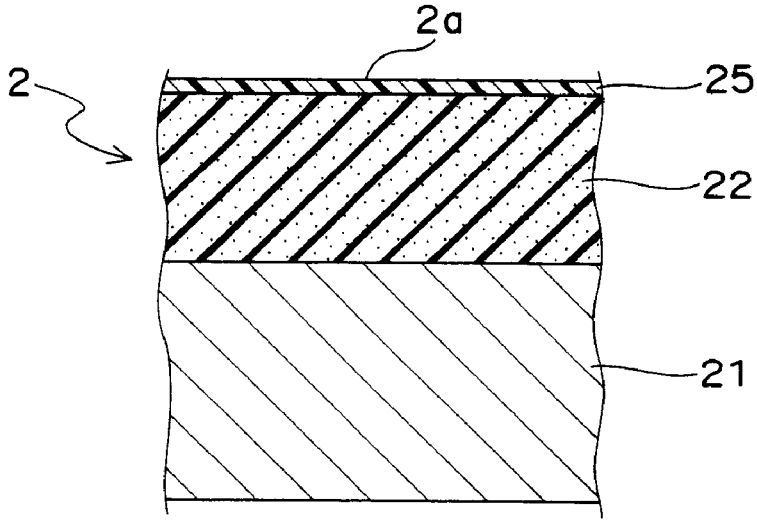
FIG. 3 is a view showing a cross sectional structure of a pressure roller in the fixing device.

As shown in FIG. 3, the pressure roller 2 has a three-layer structure composed of a mandrel 21 made of aluminum with a thickness of 3 mm, a heat insulating layer 22 made of silicon sponge rubber with a thickness of 3 mm to 10 mm and a release layer 25 made of fluorocarbon resin such as PTFE and PFA with a thickness of 10 to 50 μm placed in the order from the central side toward an outer peripheral face 2*a*.

The material of the mandrel 21 may be a heat-resistant molded pipe made of, for example, iron or PPS (polyphenylene sulfide) as long as the strength can be ensured. However, in order to prevent the mandrel 21 from generating heat, nonmagnetic materials which are less affected by electromagnetic induction heating should preferably be used.

The thickness of the heat insulating layer 22 made of silicon sponge rubber may appropriately be changed in the range of 3 mm to 10 mm in accordance with use conditions. It is to be noted that the heat insulating layer 22 may have a two-layer structure composed of silicon rubber and silicon sponge.

The outermost release layer 25 is provided to enhance the releasing property of the outer peripheral face 2*a*.

The pressure roller 2 is pressed against the fixing roller 1 shown in FIG. 1 with pressing force of 300N to 500N to form a nip section. The nip width in this case is approx. 5 mm to 15 mm. The nip width may be changed by changing a load when necessary.

The magnetic flux generating section 3 includes a coil bobbin 33 having a trapezoidal cross section and placed so as to cover the upper section of the fixing roller 1 in FIG. 1, an exciting coil 31 placed in a layer along the inclined face of the coil bobbin 33, a degaussing coil 34 placed in a layer in the state of overlapping with the exciting coil 31, and a magnetic core 32 having a trapezoidal cross section generally similar to the cross section of the coil bobbin 33 and placed along the coil bobbin 33 with the exciting coil 31 therebetween.

Figure 4:
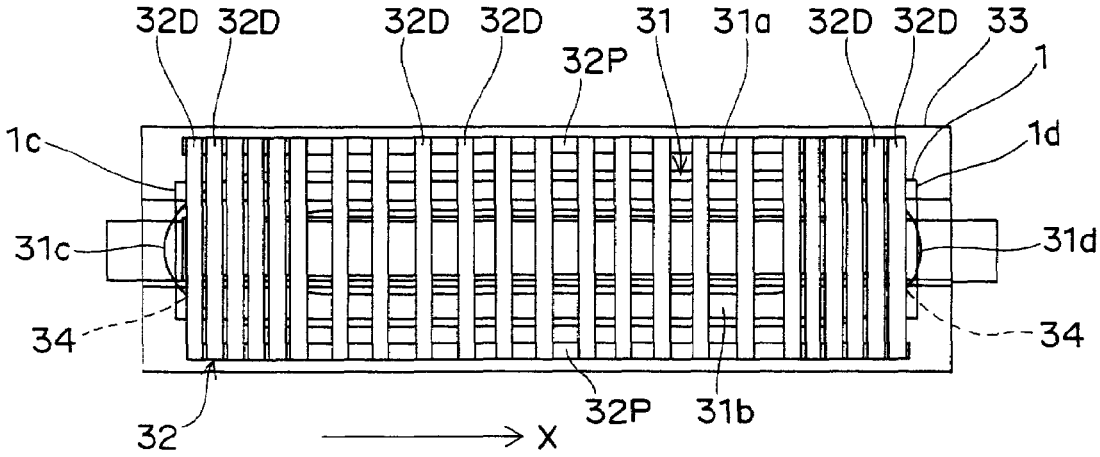
FIG. 4 is a view showing the fixing device in FIG. 1 as viewed from the top.

FIG. 4 is a view showing the coil bobbin 33, the exciting coil 31 and the magnetic core 32 as viewed from the top in FIG. 1. As shown in FIG. 4, the coil bobbin 33, the exciting coil 31 and the magnetic core 32 are long members having a length size roughly corresponding to a size of the fixing roller 1 in its longitudinal direction (axial direction) X.

The coil bobbin 33 is provided to support the exciting coil 31 and the magnetic core 32. The coil bobbin 33 should preferably be made of nonmagnetic materials and in this example is made of heat-resistant resin (e.g., polyimide) with a thickness of 1 mm to 3 mm.

The exciting coil 31 is provided to generate a magnetic flux upon reception of electric power supply from the RF inverter 4. The exciting coil 31 is formed by winding a conductor bundle for a plurality of times to form an oval shape. The conductor bundle has a forward-way section 31*a* and a return-way section 31*b* each extending along the longitudinal direction X of the fixing roller 1, and curved sections 31*c*, 31*d* connecting the forward-way section 31*a* and the return-way section 31*b* at both ends 1*c*, 1*d* of the fixing roller 1. It is to be noted that a conductor bundle is a known stranded wire with a diameter of about several millimeters formed by bunching about a hundred and several dozen wires (copper wires with a diameter of 0.18 mm to 0.20 mm coated with enamel for insulation) for enhancing conduction efficiency. This makes it possible to receive 100W to 2000W electric power with drive frequencies of 10 kHz to 100 kHz from the RF inverter 4. It is to be noted that in this example, the coil coated with heat-resistant resin is used in consideration of heat conducted to the coil.

The magnetic core 32 is provided to increase the efficiency of magnetic circuits and for magnetic shielding. In this example, the magnetic core 32 is composed of a pair of end sections 32P, 32P extending in the longitudinal direction X and a plurality of trapezoidal sections 32D (with a cross section shown in FIG. 1) integrally formed over these end sections 32P, 32P. The trapezoidal sections 32D are arrayed at narrow intervals in vicinities of both ends in the longitudinal direction X, while being arrayed at wide intervals in the inside except the vicinities of both ends in the longitudinal direction X. As the material of the magnetic core 32, magnetic materials having high magnetic permeability and low loss are used. In the case of using alloys such as permalloys, the magnetic core 32 may have a laminated structure since an eddy current loss in the core is increased by radio frequencies. The magnetic circuit section of the exciting coil 31 and the core 32 may be made coreless if there is a means to provide sufficient magnetic shielding. Moreover, using resin materials with magnetic powder dispersed therethrough allows free setting of its shape though magnetic permeability becomes relatively low. Moreover, forming the magnetic core 32 to have an E-shaped transverse section and providing a core protruding toward the fixing roller 1 in its central section allow high heat generation efficiency.

A magnetic flux generated by the exciting coil 31 passes through the inside of the magnetic core 32 without leaking to the outside, and when it reaches a portion between protrusions of the core, it leaks to the outside of the magnetic core for the first time and penetrates the heat generating layer 13 of the fixing roller 1, which causes an eddy current to flow through the heat generating layer 13 and makes the heat generating layer 13 itself generate heat (Joule heat). Since the portion immediately below the heat generating layer 13 of the fixing roller 1 is insulated by the heat insulating layer 12 (see FIG. 2), heat generated by the heat generating layer 13 swiftly heats the elastic layer 14 and the release layer 15, and the temperature of the outer peripheral face 1*a* of the fixing roller 1 (this is referred to as "fixing roller surface temperature") rises.

Figure 5:
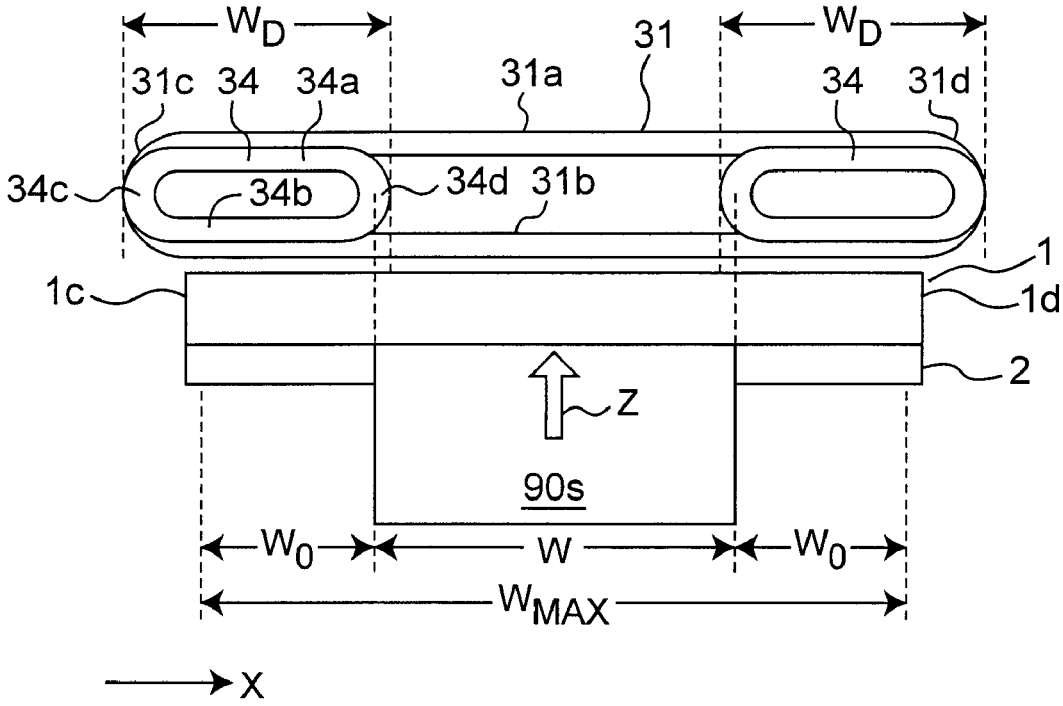
FIG. 5 is a schematic view showing the layout of an exciting coil and degaussing coils in the longitudinal direction of the fixing roller, and more particularly their corresponding relationship with a region through which a paper sheet passes.

As shown in FIG. 5 which is explained next, the degaussing coil 34 is formed by winding a conductor bundle for a plurality of times to form an oval shape as with the case of the exciting coil 31 though the degaussing coil 34 is shorter than the exciting coil 31. In this example, a pair of the degaussing coils 34 are placed on both ends of the exciting coil 31 in the X direction in the state of overlapping with the exciting coil 31. These degaussing coils 34, which are structured in a similar manner, have a forward-way section 34*a* and a return-way section 34*b* each extending along the longitudinal direction X of the fixing roller 1, and curved sections 34*c*, 34*d* connecting the forward-way section 34*a* and the return-way section 34*b*.

FIG. 5 schematically shows the layout of the exciting coil 31 and the degaussing coils 34 in the longitudinal direction X of the fixing roller 1, and more particularly their corresponding relationship with a region through which a paper sheet passes. In FIG. 5, with respect to the X direction, $W_{MAX}$ represents a region through which a maximum size paper sheet passes and W represents a central region through which a paper sheet 90*s* smaller than the maximum size paper sheet passes (paper sheets pass in the direction of an arrow Z). A region $W_0$ through which the small size paper sheet 90*s* does not pass (small size sheet non-passing region) is generated in end sections on both sides of the outer peripheral face of the fixing roller 1 with respect to the X direction. The degaussing coils 34 are provided so as to occupy regions $W_D$ which are slightly larger than the small size sheet non-passing regions $W_0$ so as to have a margin.

Heating and temperature control of the fixing roller 1 are performed by a control circuit 5 shown in FIG. 1. A temperature sensor 6, which is, for example, a thermistor, is placed so as to come into contact with the outer peripheral face 1*a* of the fixing roller 1. A detection signal representing the fixing roller surface temperature from the temperature sensor 6 is inputted into the control circuit 5. The control circuit 5 controls the RF inverter 4 based on the detection signal from the temperature sensor 6 to increase or decrease electric power supply from the RF inverter 4 to the exciting coil 31. By this, the fixing roller surface temperature is automatically controlled so that a specified constant temperature is maintained. As a result, when heat is removed by a paper sheet 90, it becomes possible to keep the fixing roller surface temperature.

During fixing operation, the pressure roller 2 is rotationally driven, and following after this rotation, the fixing roller 1 rotates. At the same time, the heat generating layer 13 of the fixing roller 1 generates heat through electromagnetic induction by a magnetic flux generated by the magnetic flux generating section 3, and the surface temperature of the fixing roller 1 is automatically controlled so that a specified constant temperature is maintained. In this state, by an unshown transportation mechanism, the paper sheet 90 as a sheet with an unfixed toner image 91 formed on one face is sent into the nip section formed from the fixing roller 1 and the pressure roller 2. In this case, the face of the paper sheet 90 with the unfixed toner image 91 formed thereon comes into contact with the fixing roller 1. The paper sheet 90 sent into the nip section formed from the fixing roller 1 and the pressure roller 2 is heated by the fixing roller 1 while passing the nip section. As a result, the unfixed toner image 91 is fixed onto the paper sheet 90. The paper sheet 90 after passing the nip section is released from the fixing roller 1 and discharged. If the paper sheet 90 should adhere to the fixing roller outer peripheral face 1*a* after passing the nip section, a separation claw 8 placed in contact with the fixing roller outer peripheral face 1*a* forcedly releases the paper sheet 90 from the fixing roller outer peripheral face 1*a* to prevent a jam.

It is to be noted that not only contact sensors such as thermistors but also noncontact sensors such as infrared sensing devices may be used as the temperature sensor 6.

Figure 6:
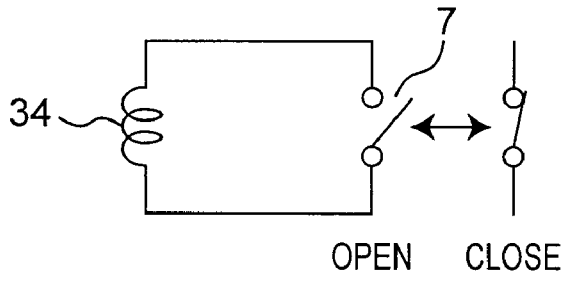
FIG. 6 is a view showing a structure of a changeover switch in the fixing device.

As shown in FIG. 6, the changeover switch 7 is provided to put the respective degaussing coils 34 in "open" state or "close" state. In this example, under the control by the control circuit 5, the changeover switch 7 opens or closes the respective degaussing coils 34 in accordance with the size of a paper sheet to be transported. More specifically, when the maximum size paper sheet 90 passes through the nip section between the fixing roller 1 and the pressure roller 2 in FIG. 1, the changeover switch 7 is put in the open state. In this case, the degaussing effect by the degaussing coils 34 is not generated. When the small size paper sheet 90*s* passes through the nip section, the changeover switch 7 is put in the close state. In this case, the degaussing coil 34 generates a magnetic field (opposing magnetic field) in the direction in which the magnetic field is prevented from being changed by the exciting coil 31, fulfilling the degaussing effect. As a result, it becomes possible to prevent excessive temperature rise of the fixing roller 1 in the regions $W_D$ where the degaussing coils 34 are placed, or practically in the small size sheet non-passing regions $W_0$.

In such a case, it becomes possible to prevent deterioration of the fixing roller 1 due to excessive temperature rise and to increase durability and speed of the fixing device without the necessity of providing a magnetic flux generating section exclusive for the small size paper sheet 90*s* and without lowering the original throughput of the fixing device.

Figure 10:
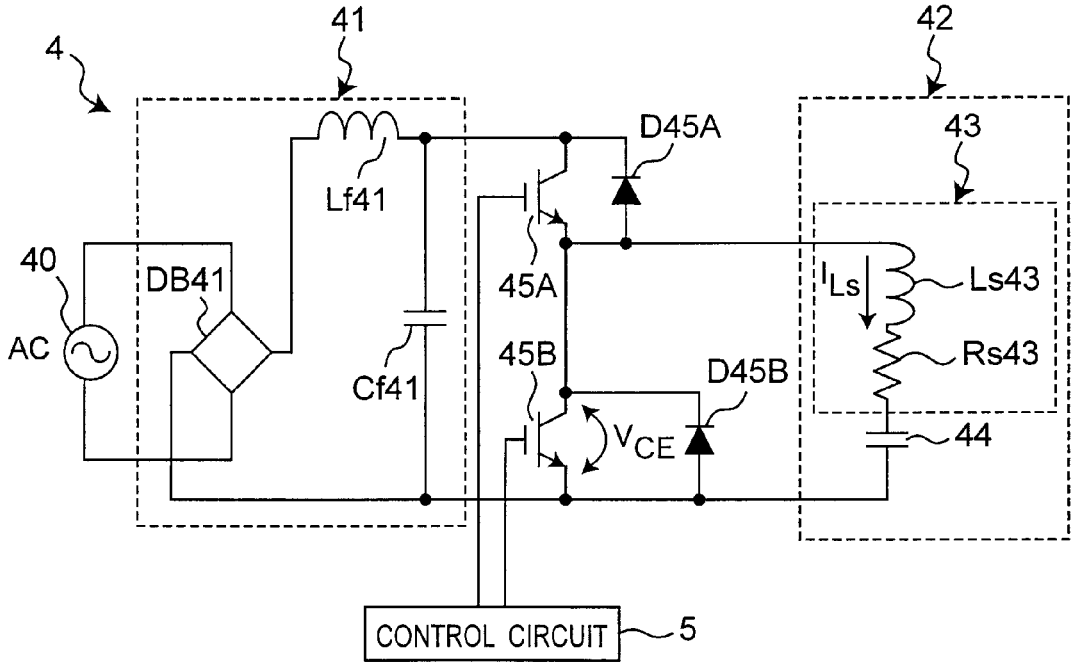
FIG. 10 is a view specifically showing an example in which the RF inverter for applying a current to the IH unit in the fixing device is constituted of a series resonant circuit.

FIG. 10 specifically shows the circuit structure of the RF inverter 4 for applying a current to the IH unit 43. The possible circuit structure of the RF inverter 4 includes a parallel resonant circuit and a series resonant circuit. FIG. 10 is an example showing a preferable series resonant circuit.

Figure 7:
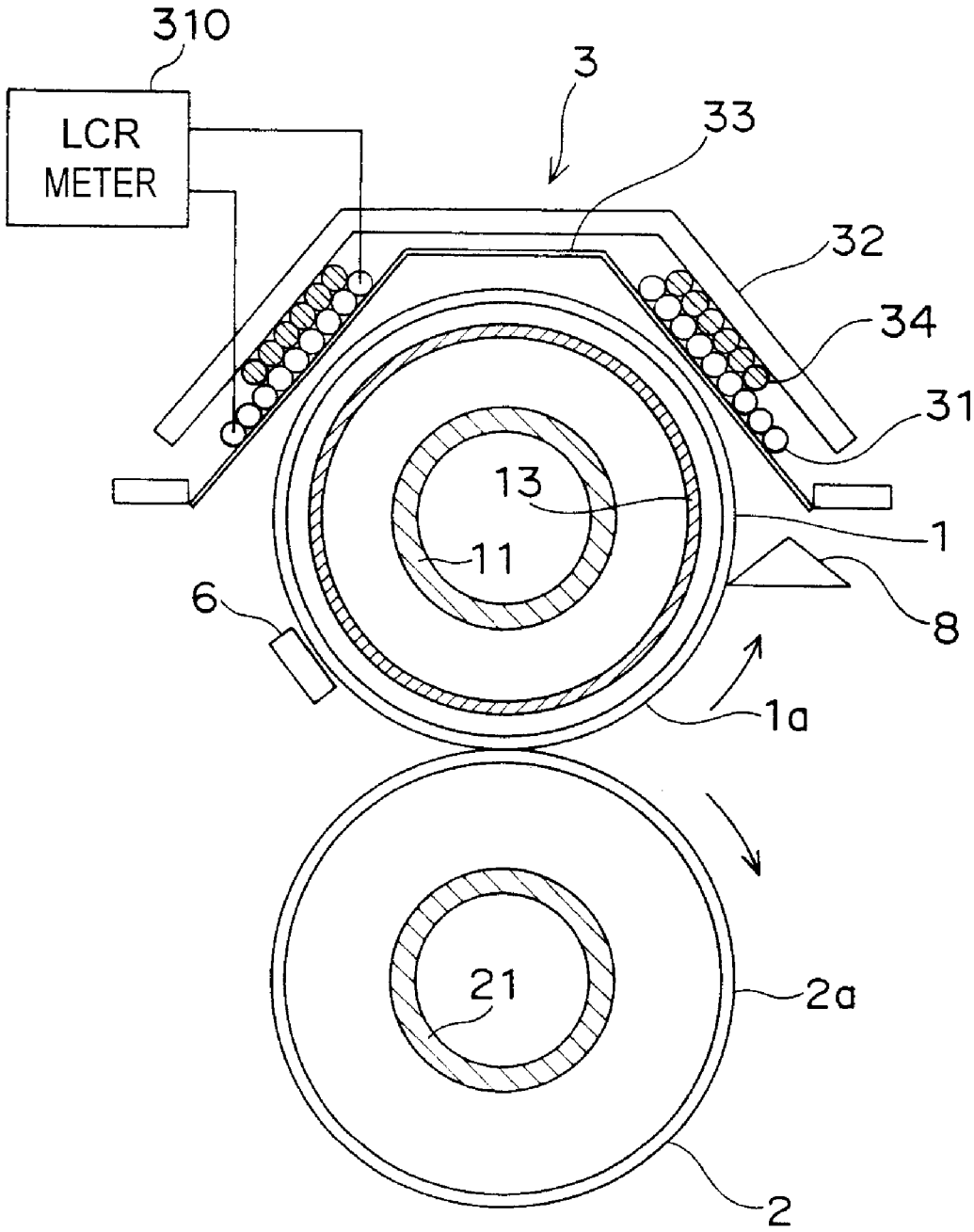
FIG. 7 is a view explaining a method for observing an inductance $L_S$ and an effective resistance $R_S$ of an IH unit in the fixing device.

The IH unit 43, which includes contribution from the fixing roller 1, the core 32 and the degaussing coils 34 to be coupled with the exciting coil 31 by electromagnetic induction as well as contribution from the exciting coil 31 in the magnetic flux generating section 3 shown in FIG. 1, is shown as a series equivalent circuit composed of an inductance Ls43 and an effective resistance Rs43 in FIG. 10. It is to be noted that values of the inductance Ls43 and the effective resistance Rs43 may be measured by connecting an impedance measuring device 310 generally called an LCR meter to both end sections of the exciting coil 31 in the magnetic flux generating section 3 as shown in FIG. 7.

A resonant capacitor 44 is connected in series to the IH unit 43 or practically to the exciting coil 31 to constitute a series resonant circuit 42. A resonance frequency $f_0$ (unit: Hz) of the series resonant circuit 42 is given by Equation (1):

$$f_0=1/(2\pi(LsC)^{1/2}) \quad (1)$$

where Ls represents a value of the inductance Ls43 (unit: H (henry)), and C represents capacity of the resonant capacitor 44 (unit: F (farad)).

The RF inverter 4 is composed of an AC power source 40, a diode bridge DB41, a rectification circuit 41 composed of a smoothing coil Lf41 and a smoothing capacitor Cf41, a pair of switching elements 45A, 45B each made of power transistors, and flywheel diodes D45A, D45B for protecting these switching elements 45A, 45B from overvoltage.

The pair of switching elements 45A, 45B are on/off controlled with a certain drive frequency f by the control circuit 5 serving as a control section. Thus, electric power is inputted into the IH unit 43, more specifically, into the fixing roller 1 through the magnetic flux generating section 3.

Figure 11:
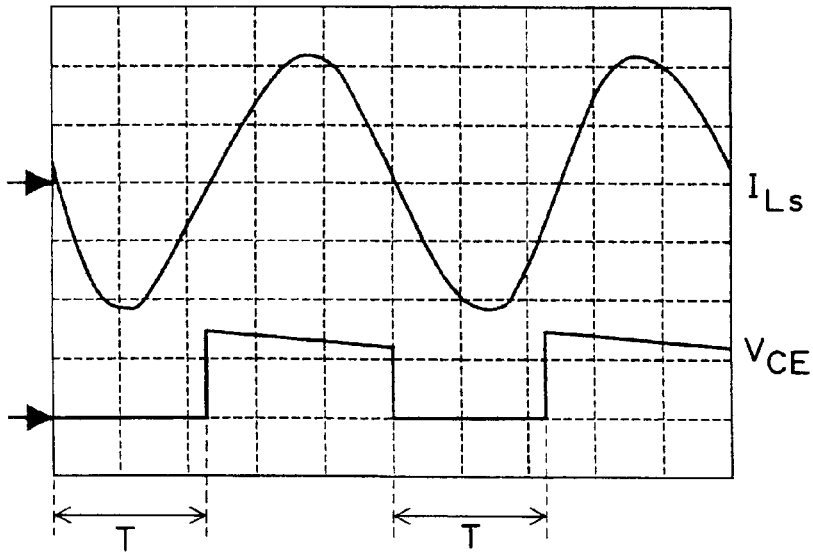
FIG. 11 is a view showing drive waveforms of the series resonant circuit constituting the RF inverter of the fixing device.

It is to be noted that FIG. 11 shows drive waveforms of the series resonant circuit 42, in which $I_{LS}$ denotes a current flowing through the IH unit 43, $V_{CE}$ denotes a collector-emitter voltage of the respective switching elements 45A, 45B, and T denotes a turn-on period of the switching elements.

In the series resonant circuit 42, when the drive frequency f and the resonance frequency $f_0$ are equal to each other, an impedance Z is minimized and a current flow is maximized. This maximizes electric power inputted into the fixing roller 1 through the magnetic flux generating section 3 (this is called "maximum input power $Pw_{MAX}$" as appropriate). Therefore, even when the heat generating layer of the fixing roller 1 has a thickness as thin as 100 μm or less and the drive frequency f is set high as in the case of this example, high electric power can be inputted. That is, high heat generation efficiency and high input power can be achieved at the same time. As a result, it becomes possible to warm up the device in a short period of time and to increase a paper passing speed.

The electric power inputted into the fixing roller 1 can be controlled by increasing the drive frequency f slightly from the resonance frequency $f_0$ so as to slightly decrease the current flowing to the series resonant circuit 42.

Figure 12:
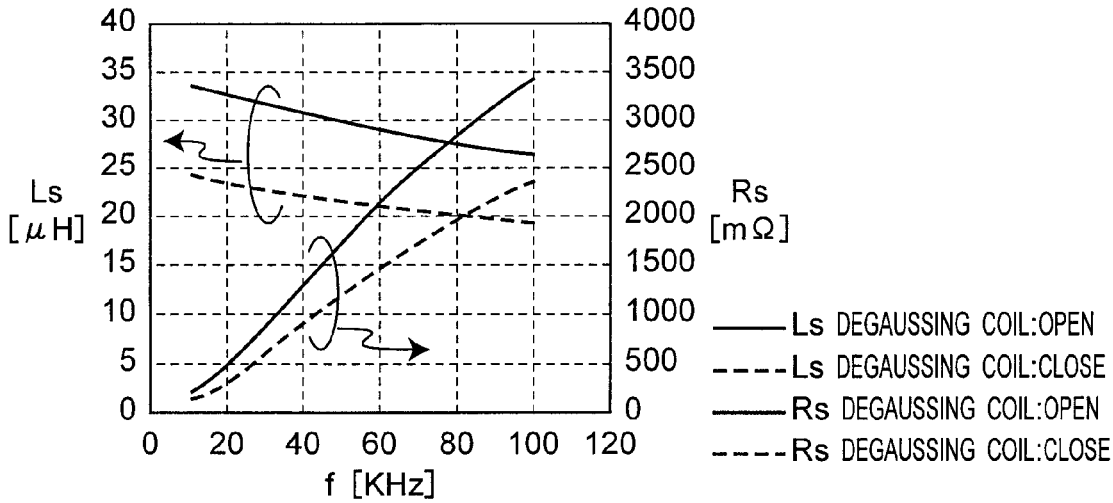
FIG. 12 is a view showing an inductance $L_S$ and an effective resistance $R_S$ of the IH unit in the fixing device in states of the degaussing coil being opened and closed, respectively.

As described in the conventional example, along with opening or closing of the degaussing coil 34, a load applied onto the exciting coil 31 as viewed from the power supply side (inverter circuit), i.e., the inductance Ls43 and the effective resistance Rs43 of an equivalent circuit (IH unit 43), which is composed of the exciting coil, and the degaussing coil and the fixing roller electromagnetically coupled with the exciting coil, change. More specifically, in FIG. 12, Ls and Rs values in the state of the degaussing coil 34 being opened are shown by solid lines, while Ls and Rs values in the state of the degaussing coil 34 being closed are shown by broken lines. As is clear from FIG. 12, changing the degaussing coil 34 from open to close decreases both Ls and Rs values. Accordingly, the resonance waveform of the series resonant circuit 42 changes from the waveform shown by a solid line to the waveform shown by a broken line in FIG. 13. That is, the resonance frequency shifts to the high frequency side, from $f_{01}$ to $f_{02}$, and an input power value (power peak value) at the resonance frequency increases.

Herein, in the fixing device, along with opening or closing of the degaussing coil 34, the control circuit 5 shown in FIG. 1 changes and sets the drive frequency f of the RF inverter 4.

More specifically, as shown in FIG. 15, a drive frequency table containing predetermined values of the drive frequency f, which should be set in accordance with set power amounts for making the fixing roller 1 generate heat and with opening or closing of the degaussing coil 34, is made available in advance. Then, in synchronization with opening or closing of the degaussing coil 34, the control circuit 5 immediately makes reference to the drive frequency table and sets the drive frequency f of the RF inverter 4. For example, when the set power amount is 600W and the degaussing coil 34 is changed from open to close, the drive frequency f is moved to the high frequency side, from 41.6 kHz to 44.3 kHz, and set at this value. Moreover, when the set power amount is 1200 W and the degaussing coil 34 is changed from close to open, the drive frequency f is moved to the low frequency side, from 43.2 kHz to 40.2 kHz, and set at this value. It should naturally be understood that the data showing values of the drive frequency f in the drive frequency table are not limited to values shown in FIG. 15 but are appropriately set on a case-by-case basis in conformity to the fixing device, and more specifically to the characteristics of the IH unit 43 (inductance Ls43, effective resistance Rs43 and the like).

In the fixing device, electric power inputted into the fixing roller 1 is expected to be controlled smoothly immediately after changeover of the drive frequency f. Therefore, a frequency in the column "degaussing coil: open" in the drive frequency table corresponds to a point on a slope slightly larger than the resonance frequency $f_{01}$ on the resonance waveform (solid line) representing the degaussing coil 34 in the open state shown in FIG. 13. Similarly, a frequency in the column "degaussing coil: close" in the drive frequency table corresponds to a point on a slope slightly larger than the resonance frequency $f_{02}$ on the resonance waveform (broken line) representing the degaussing coil 34 in the close state shown in FIG. 13.

Although the drive frequency table in FIG. 15 shows only the values of the drive frequency f for the degaussing coil 34 in the open state and in the close state each with typical set power amounts of 300W, 600W, 900W and 1200W for the sake of simplicity, an actual table contains values of the drive frequency f for the degaussing coil 34 in the open state and in the close state each with set power amounts at an electric power resolution pitch available as a system.

Thus, the control circuit 5 changes and sets the drive frequency f of the RF inverter 4 along with opening or closing of the degaussing coil 34, so that even immediately after open/close changeover of the degaussing coil 34, a desired amount of electric power can be inputted into the fixing roller 1. Therefore, problems such as occurrence of temperature ripples in the circumferential direction of the fixing roller 1 caused by opening or closing of the degaussing coil 34 can be solved.

Figure 14:
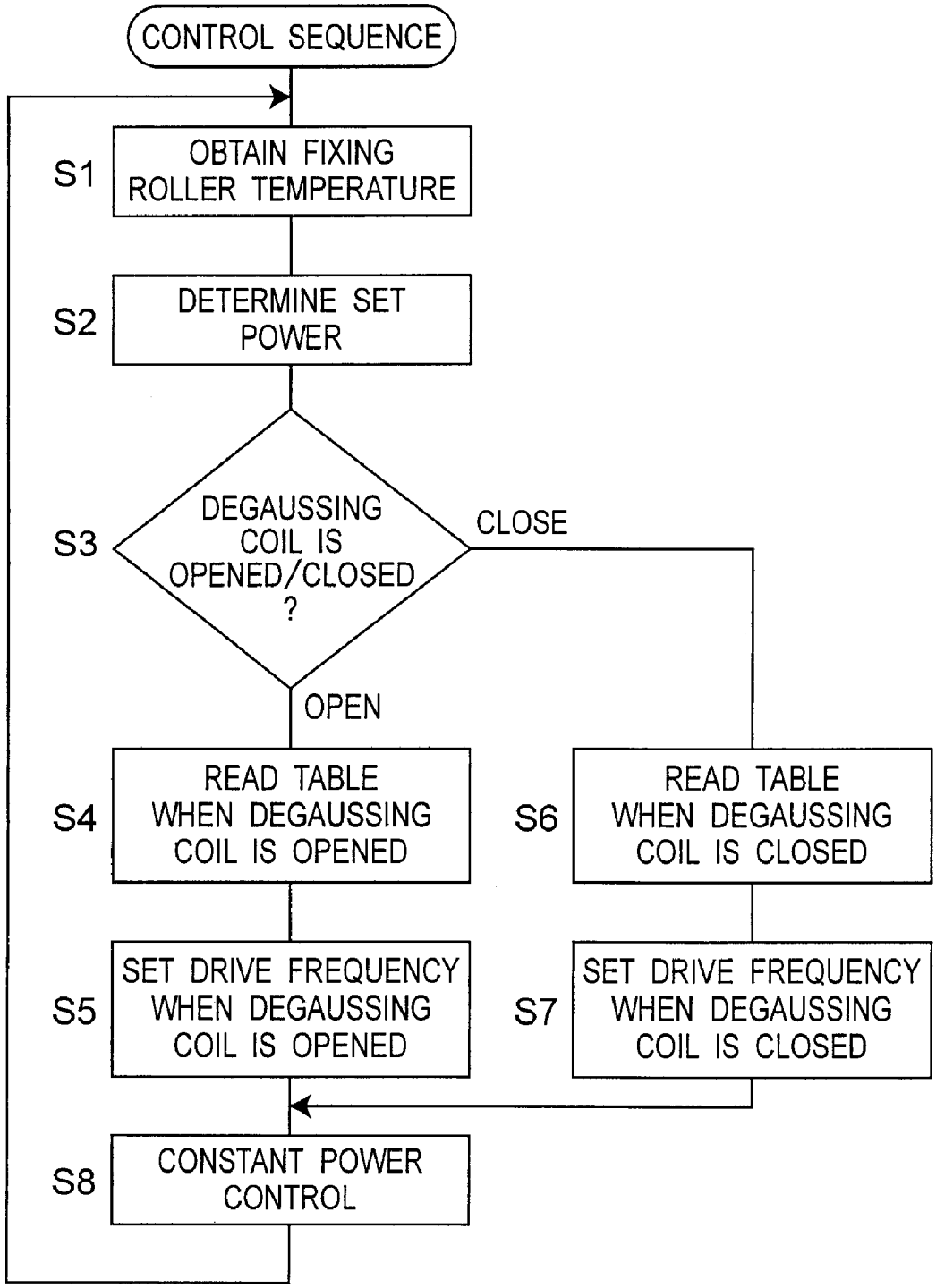
FIG. 14 is a flowchart showing a control sequence executed by a control circuit in the fixing device.

FIG. 14 shows a specific control sequence executed by the control circuit 5. First, a fixing roller surface temperature is obtained based on an output by the temperature sensor 6 (S1), and a set power amount is determined (S2). Next, it is determined whether the degaussing coil 34 is opened or closed (S3). This determination is made based on, for example, a paper size selected by users or a transmission data size. In this case, if the degaussing coil 34 is determined to be "open", then a value of the drive frequency f put in the column "degaussing coil: open" for the set power amount is read from the drive frequency table in FIG. 15 (S4), and the degaussing coil 34 is set to be "open", while at the same time, the value of the drive frequency f is set as the drive frequency of the RF inverter 4 (S5). If the degaussing coil 34 is determined to be "close" in the step S3, then a value of the drive frequency f put in the column "degaussing coil: close" for the set power amount is read from the drive frequency table in FIG. 15 (S6), and the degaussing coil 34 is set to be "close", while at the same time, the value of the drive frequency f is set as the drive frequency of the RF inverter 4 (S7). Next, a voltage of the set drive frequency is applied by the RF inverter 4 to the IH unit 43 or in actuality to the exciting coil 31. By this, constant power control for making the heat generating layer of the fixing roller 1 generate heat, measuring an actual current value and a voltage value, and tuning the electric power to a desired value in real time is executed (S8). Then, while the constant power control is executed, a paper sheet is transported through the nip section between the fixing roller 1 and the pressure roller 2 shown in FIG. 1 and toner is fixed onto the sheet.

It is to be noted that only one of data sets in "degaussing coil: open" column and in "degaussing coil: close" column in the drive frequency table in FIG. 15, e.g., the data set in "degaussing coil: open" column which is considered higher in frequency of use, may be made ready, and the other data set in "degaussing coil: close" column may be calculated in real time based on the data set in "degaussing coil: open" column while the constant power control is executed.

Figure 13:
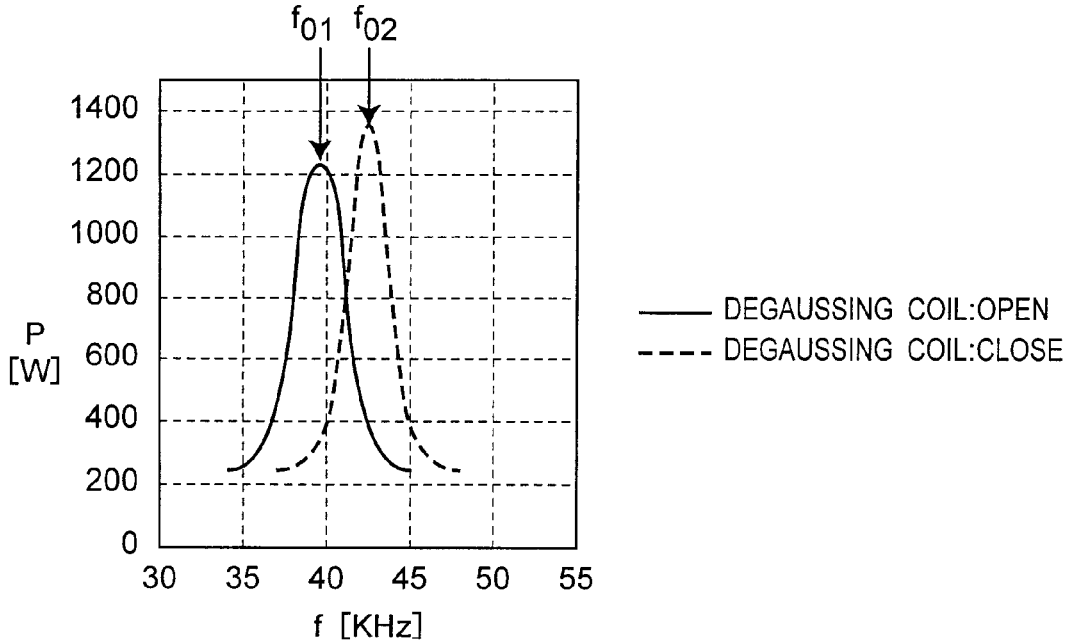
FIG. 13 is a graph showing a relationship (resonance waveforms) between electric power inputted into the IH unit and drive frequencies in states of the degaussing coil 34 being opened and closed, respectively.

The other data set in "degaussing coil: close" may be calculated by, for example, adding a certain difference to the data set in "degaussing coil: open" column. As the "certain difference" to be added, an optimum value should be set based on the relationship between an input power amount P and a drive frequency f in states of the degaussing coil 34 being opened and closed (FIG. 13).

Alternatively, only the data set in "degaussing coil: close" may be made ready, and the other data set in "degaussing coil: open" column may be calculated in real time based on the data set in "degaussing coil: close" column while the constant power control is executed.

In either way, when the degaussing coil 34 is changed from open to close, the drive frequency f is moved to the high frequency side and set at the resultant value. Moreover, when the degaussing coil 34 is changed from close to open, the drive frequency f is moved to the low frequency side and set at the resultant value.

Moreover, the "difference" may not be constant over the entire region of the set power amounts, but may be variably set in accordance with the set power amounts. By this, control over changeover of the drive frequency f in the RF inverter 4 along with opening or closing of the degaussing coil 34 can be performed accurately in accordance with the set power amounts.

Moreover, instead of adding the "difference", an amount to be added may be determined by a ratio to the drive frequency f.

Figure 8:
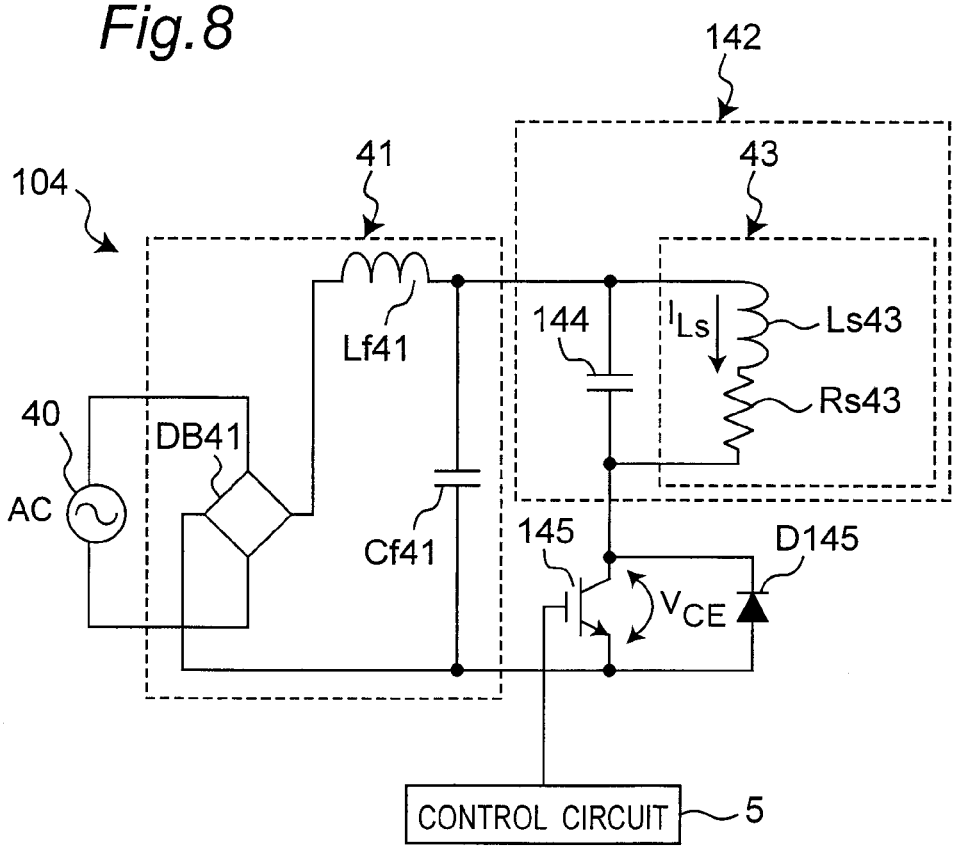
FIG. 8 is a view specifically showing an example in which an RF inverter for applying a current to the IH unit in the fixing device is constituted of a parallel resonant circuit.

FIG. 8 shows an example in which an RF inverter (designated by reference numeral 104) for applying a current to the IH unit 43 is constituted of a parallel resonant circuit 142 instead of the series resonant circuit 42 shown in FIG. 10. It is to be noted that like component members are also designated by like reference numerals in FIG. 10 and redundant description will be omitted.

In the parallel resonant circuit 142, a resonant capacitor 144 is connected in parallel to the IH unit 43, i.e., the exciting coil 31. A switching element 145 is on/off controlled with a certain drive frequency f by the control circuit 5 serving as a control section. Thus, electric power is inputted into the IH unit 43, more specifically into the fixing roller 1 through the magnetic flux generating section 3.

Figure 9:
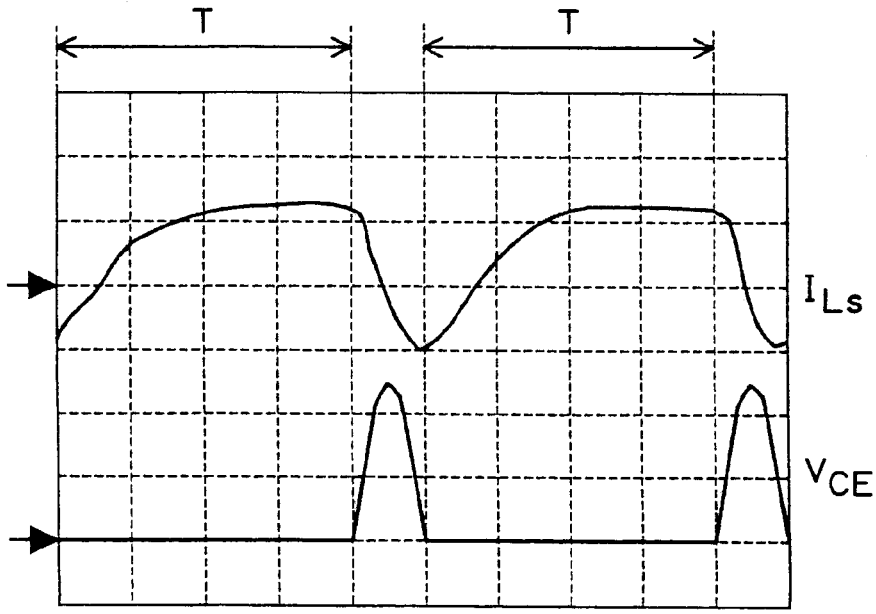
FIG. 9 is a view showing drive waveforms of the parallel resonant circuit constituting the RF inverter of the fixing device.

Moreover, FIG. 9 shows drive waveforms of the parallel resonant circuit 142. The gradient of a current $I_{LS}$ shown by the drive waveform is determined by an inductance $L_S$, and a peak current value is determined by an effective resistance $R_s$. More particularly, an input power amount (depending on the current $I_{LS}$ flowing through the coil) inputted into the IH unit 43 in the case of the parallel resonant circuit 142 depends on the inductance $L_S$ and the effective resistance $R_s$. Therefore, in the parallel resonant circuit, as with the case of the series resonant circuit 42, control over changeover of the drive frequency f in the RF inverter 4 along with opening or closing of the degaussing coil 34 becomes effective. More specifically, along with opening or closing of the degaussing coil 34, the drive frequency f of the RF inverter 104 is changed to a drive frequency (corresponding to the turn-on period of the switching element) which allows input of a desired electric power amount. As a result, even immediately after open/close changeover of the degaussing coil 34, a desired amount of electric power can be inputted into the fixing roller 1. Therefore, problems such as occurrence of temperature ripples in the circumferential direction of the fixing roller 1 caused by opening or closing of the degaussing coil 34 can be solved. It should naturally be understood that it is more preferable to perform more specific constant power control.

It is to be noted that as already known, in the case where the heat generating layer 13 (nickel layer) of the fixing roller 1 has a thickness as thin as 100 μm or less as in the present embodiment, high heat generation efficiency can be attained by driving the fixing roller 1 at higher frequencies to decrease a depth of penetration (unit: m) shown by Equation (2).

$$(\text{Depth of penetration})=(\pi f\mu\rho)^{-1/2} \quad (2)$$

where f represents a drive frequency (unit: Hz), μ represents magnetic permeability of the heat generating layer (unit: H/m) and ρ represents conductivity of the heat generating layer (unit: S/m).

In the case where, for example, the heat generating layer (nickel layer) has a thickness of 40 μm, the drive frequency f is required to be at least about 40 kHz and ideally be 60 kHz or more.

As is clear from the drive waveforms in FIG. 9, in the parallel resonant circuit 142, input power (depending on a current $I_{LS}$ flowing through the coil) is dependent on the length of a turn-on period T of the switching element (a period during which a collector-emitter voltage $V_{CE}$ is low). If the drive frequency f is made higher, the turn-on period T of the switching element is shortened and this makes it difficult to secure high input power. For example, for securing electric power of about 1200W, an upper limit of the drive frequency f is about 25 kHz~30 kHz. Moreover, increasing the drive frequency also increases the collector-emitter voltage $V_{CE}$ of the switching element, and this puts the switching element itself under harsh conditions. Therefore, it is preferable to employ the series resonant circuit 42 as shown in FIG. 10 rather than the parallel resonant circuit 142.

Although in the present embodiment, the fixing roller is provided as the fixing member, the fixing member is not limited thereto and so a fixing belt may be provided as the fixing member. The material and the structure of the fixing member are not limited to those disclosed in the present embodiment but may be modified as appropriate within the applicable range of the present invention.

Further, although in the present embodiment, the degaussing coils 34, 34 are provided one for each of the end sections $W_0$, $W_0$, on both end sides in the longitudinal direction of the fixing roller 1 as shown in FIG. 5, the structure of the degaussing coil is not limited thereto. For example, in the case where there are two or more kinds of paper sheets smaller in size than the maximum size paper sheet 90, the degaussing coil 34 may be divided into a plurality of coils according to the paper sheet sizes. In that case, every divided degaussing coil has a changeover switch 7. Then, in accordance with the paper sheet sizes, these respective divided degaussing coils are opened or closed step by step by the respective changeover switches 7. For example, an unshown temperature sensor and an unshown control circuit are provided in the regions $W_D$ where the degaussing coils 34 are placed, in other words, in the end sections $W_0$, $W_0$ on both sides in the longitudinal direction of the fixing roller 1, by which the changeover switches 7 are opened or closed step by step. By this, in accordance with various paper sheet sizes, the temperature in the end sections $W_0$, $W_0$ on both sides in the longitudinal direction of the fixing roller 1 can be adjusted.

Moreover, although in the present embodiment, the changeover switch 7 is on/off controlled by the control circuit 5, the present invention is not limited to this structure and so the changeover switch 7 may be controlled by, for example, an upper control section that is in an image forming apparatus to which the fixing device is applied.

Figure 16:
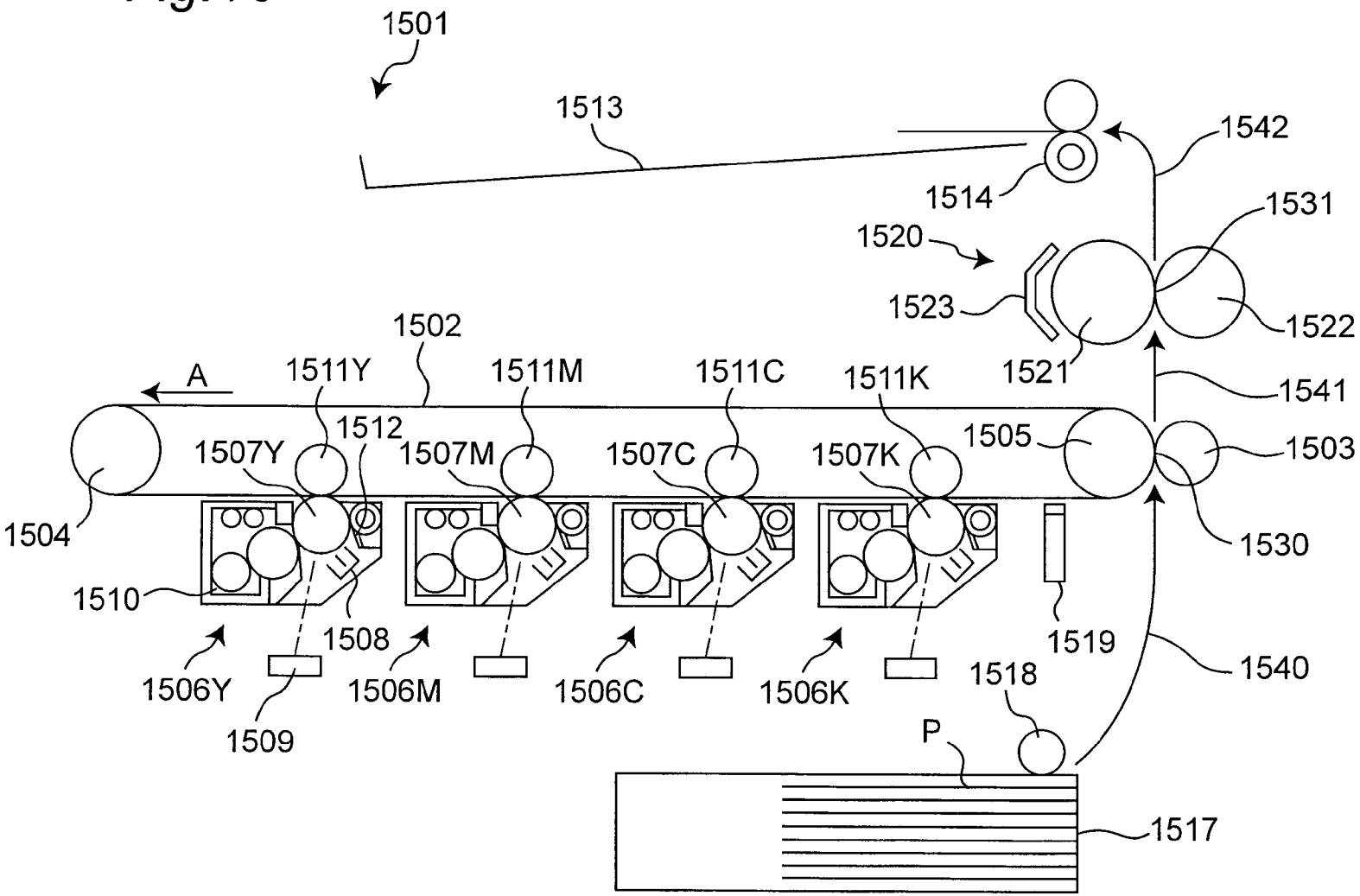
FIG. 16 is a view showing a structure of an image forming apparatus having the fixing device in one embodiment of the present invention.

FIG. 16 shows the structure of an image forming apparatus 1501 having a fixing device 1520 in one embodiment.

Description is first given of an outlined structure of the image forming apparatus 1501. The image forming apparatus 1501 has an intermediate transfer belt 1502 as a belt member in the central section in the inside thereof. The intermediate transfer belt 1502 is supported by outer peripheral sections of rollers 1504, 1505 and is rotationally driven in an arrow A direction. The intermediate transfer belt drive roller 1505 is linked to an unshown drive motor, and the roller 1504 rotates following after rotation of the intermediate transfer belt drive roller 1505.

Under a lower horizontal section of the intermediate transfer belt 1502, four imaging units 1506Y, 1506M, 1506C, 1506K respectively corresponding to colors Yellow (Y), Magenta (M), Cyan (C), Black (K) are placed side by side along the intermediate transfer belt 1502.

The imaging units 1506Y, 1506M, 1506C, 1506K respectively have photoreceptor drums 1507Y, 1507M, 1507C, 1507K. Around the respective drums 1507Y, 1507M, 1507C, 1507K, charging devices 1508, print head sections 1509, developing devices 1510, primary transfer rollers 1511Y, 1511M, 1511C, 1511K facing the photoreceptor drums 1507Y, 1507M, 1507C, 1507K across the intermediate transfer belt 1502, respectively, and cleaners 1512 are placed in the order along the rotation direction.

A portion of the intermediate transfer belt 1502 supported by the intermediate transfer belt drive roller 1505 is brought into pressure contact with a secondary transfer roller 1503, and a nip section between the secondary transfer roller 1503 and the intermediate transfer belt 1502 constitute a secondary transfer region 1530.

In a downstream position of a transportation line 1541 at the rear of the secondary transfer region 1530, the fixing device 1520 composed of a fixing roller 1521, a pressure roller 1522 and a magnetic flux generating section 1523 is placed. A pressure contact portion between the fixing roller 1521 and the pressure roller 1522 constitutes a fixing nip section 1531. Although omitted in FIG. 16, the fixing device 1520 has a degaussing coil 34 between the fixing roller 1521 and the magnetic flux generating section 1523 as with the fixing device shown in FIG. 1, and also has a control circuit 5, an RF inverter 4 and a changeover switch 7. The fixing device 1520 turns on and off the changeover switch 7 in accordance with a signal representing a paper sheet size sent from an unshown control section of the image forming apparatus so as to open or close the degaussing coil 34.

Under a printer 1, a paper feed cassette 1517 is detachably placed. Paper sheets P (including the maximum size paper sheets 90 and the small size paper sheets 90*s*) housed in the paper feed cassette 1517 in a stacked state are sent out one by one from the uppermost sheet to a transportation line 1540 by rotation of a paper feed roller 1518.

An AIDC (Auto-Image Density Control) sensor 1519 functioning also as a resist sensor is placed between the imaging unit 1506K on the most downstream side of the intermediate transfer belt 1502 and the secondary transfer region 1530. The resist sensor 1519 measures intervals between patterns of respective colors formed on the intermediate transfer belt 1502, and compares the intervals with preset reference values to adjust write start timing of images of respective colors.

Description is now given of the outlined operation of the image forming apparatus 1501 structured as shown above. Once an image signal is inputted from an external apparatus (e.g., personal computers) into an image signal processing section (unshown) in the image forming apparatus 1501, the image signal processing section converts the image signal in color to yellow, cyan, magenta and black to create digital image signals, and based on the inputted digital signals, the print head sections 1509 of the respective imaging units 1506Y, 1506M, 1506C, 1506K emit light for exposure. By this, electrostatic latent images for respective colors are formed on the surfaces of the photoreceptor drums 1507Y, 1507M, 1507C, 1507K.

The electrostatic latent images formed on the respective photoreceptor drums 1507Y, 1507M, 1507C, 1507K are developed by the respective developing devices 1510 to make toner images of respective colors. Then, by the action of the respective primary transfer rollers 1511Y, 1511M, 1511C, 1511K, the toner images of respective colors are overlapped in sequence on top of the intermediate transfer belt 1502 moving in the arrow A direction for primary transfer.

The overlapped toner images formed in this way on the intermediate transfer belt 1502 reach the secondary transfer region 1530 as the intermediate transfer belt 1502 moves. In the secondary transfer region 1530, the overlapped toner images of respective colors are collectively secondary-transferred onto a paper sheet P by the action of the secondary transfer roller 1503.

Next, the toner images secondary-transferred onto the paper sheet P reach the fixing nip section 1531. In the fixing nip section 1531, the toner images are fixed onto the paper sheet P by the actions of the fixing roller 1521 and the pressure roller 1522 which generate heat through induction by the magnetic flux generating section 1523.

During the fixing operation, as with the fixing device shown in FIG. 1, the fixing device 1520 operates such that the control circuit 5 changes and sets a drive frequency f of the RF inverter 4 along with opening or closing of the degaussing coil 34. Therefore, even immediately after open/close changeover of the degaussing coil 34, a desired amount of electric power may be inputted into the fixing roller 1521. Therefore, problems such as occurrence of temperature ripples in the circumferential direction of the fixing roller 1521 caused by opening or closing of the degaussing coil 34 can be solved.

The paper sheet P with the toner images fixed thereon is discharged onto a paper discharge tray 1513 through a paper discharge roller 1514.

It is to be noted that the image forming apparatus may be any one of monochrome/color copiers, printers, facsimiles and multi-function machines of these.

The invention being thus described, it will be obvious that the same may be varied in many ways. Such variations are not be regarded as a departure from the spirit and scope of the invention, and all such modifications as would be obvious to one skilled in the art are intended to be included within the scope of the following claims.

The invention claimed is:

1. A fixing device, comprising:

a fixing member having an outer peripheral face with which a sheet to be transported is brought into pressure contact;

an exciting coil placed along the outer peripheral face of the fixing member to form an elongated shape with respect to a width direction of the sheet to be transported for induction heating of a heat generating layer of the fixing member;

an RF power supply circuit for applying a voltage of a certain drive frequency to the exciting coil so as to make the heat generating layer of the fixing member generate heat through the exciting coil;

a degaussing coil placed in a small size sheet non-passing region corresponding to a part of the outer peripheral face of the fixing member with respect to the width direction of the sheet along the exciting coil;

a changeover switch for opening or closing the degaussing coil in accordance with a size of the sheet to be transported; and a control section for changing and setting a drive frequency of the RF power supply circuit along with opening or closing of the degaussing coil.

2. The fixing device according to claim 1, wherein the RF power supply circuit includes a capacitor connected in series to the exciting coil to equivalently constitute a series resonant circuit, and when the degaussing coil is changed from close to open, the control section moves the drive frequency to a side higher than a resonance frequency of the series resonant circuit in a state of the degaussing coil being opened, whereas when the degaussing coil is changed from open to close, the control section moves the drive frequency to a side higher than the resonance frequency of the series resonant circuit in a state of the degaussing coil being closed.

3. The fixing device according to claim 1, wherein the RF power supply circuit includes a capacitor connected in series to the exciting coil to equivalently constitute a series resonant circuit, and when the degaussing coil is changed from close to open, the control section moves the drive frequency in accordance with a resonance frequency of the series resonant circuit shifting to a lower side, whereas when the degaussing coil is changed from open to close, the control section moves the drive frequency in accordance with the resonance frequency of the series resonant circuit shifting to a higher side.

4. The fixing device according to claim 1, comprising:

a drive frequency table containing predetermined values of the drive frequencies which should be set in accordance with set power amounts for making the fixing member generate heat and with opening or closing of the degaussing coil.

5. The fixing device according to claim 1, wherein the control section moves the drive frequency of the RF power supply circuit by a specified amount along with opening or closing of the degaussing coil.

6. The fixing device according to claim 5, wherein the amount of the drive frequency of the RF power supply circuit that the control section moves along with opening or closing of the degaussing coil is constant over an entire region of set power amounts for making the fixing member generate heat.

7. The fixing device according to claim 5, wherein the amount of the drive frequency of the RF power supply circuit that the control section moves along with opening or closing of the degaussing coil is variably set in accordance with a certain set power amount for making the fixing member generate heat.

8. The fixing device according to claim 1, wherein the control section controls the RF power supply circuit in such a way that after changing and setting the drive frequency of the RF power supply circuit along with opening or closing of the degaussing coil, an actual amount of electric power for making the fixing member generate heat continues to be a certain set power amount.

9. The fixing device according to claim 8, wherein after changing and setting the drive frequency of the RF power supply circuit, the control section maintains the drive frequency of the RF power supply circuit on a side slightly higher than the resonance frequency of the series resonant circuit.

10. The fixing device according to claim 1, wherein the fixing member is a cylindrical roller.

11. The fixing device according to claim 1, wherein the fixing member is an endless belt.

12. The fixing device according to claim 1, wherein the small size sheet non-passing region corresponds to end sections on both sides of the outer peripheral face of the fixing member with respect to the width direction of the sheet.

13. An image forming apparatus, comprising:

an image forming section for attaching toner onto a sheet; and the fixing device according to claim 1.

14. An image forming method with use of an image forming section for attaching toner onto a sheet and the fixing device according to claim 1, comprising the steps of:

attaching toner onto a sheet and feeding the sheet to the fixing device by the image forming section;

opening or closing the degaussing coil in accordance with a size of the sheet, and changing and setting a drive frequency of the RF power supply circuit along with opening or closing of the degaussing coil by the control section; and fixing the toner on the sheet by applying a voltage of the changed drive frequency to the exciting coil by the RF power supply circuit so as to make the heat generating layer of the fixing member generate heat through the exciting coil.

* * * * *